US008100203B2

(12) United States Patent
Lockwood et al.

(10) Patent No.: US 8,100,203 B2
(45) Date of Patent: Jan. 24, 2012

(54) DIAMOND IMPREGNATED BITS AND METHOD OF USING AND MANUFACTURING THE SAME

(75) Inventors: Gregory T. Lockwood, Pearland, TX (US); Jonan Fulenchek, Tomball, TX (US)

(73) Assignee: Smith International, Inc., Houston, TX (US)

( * ) Notice: Subject to any disclaimer, the term of this patent is extended or adjusted under 35 U.S.C. 154(b) by 822 days.

(21) Appl. No.: 12/121,504

(22) Filed: May 15, 2008

(65) Prior Publication Data

US 2009/0283336 A1 Nov. 19, 2009

(51) Int. Cl.
*E21B 10/36* (2006.01)

(52) U.S. Cl. ..... 175/434; 175/433; 51/295

(58) Field of Classification Search ..... 175/426, 175/428, 431, 433, 434; 51/295
See application file for complete search history.

(56) References Cited

U.S. PATENT DOCUMENTS

| | | | | |
|---|---|---|---|---|
| 4,723,996 | A | 2/1988 | Brunet et al. | |
| 5,089,182 | A | 2/1992 | Findeisen et al. | |
| 6,095,265 | A | 8/2000 | Alsup | |
| 6,193,000 | B1 | 2/2001 | Caraway et al. | |
| 6,394,202 | B2 | 5/2002 | Truax et al. | |
| 6,742,611 | B1 * | 6/2004 | Illerhaus et al. | 175/433 |
| 2006/0081402 | A1 | 4/2006 | Lockwood et al. | |
| 2006/0162967 | A1 * | 7/2006 | Brackin et al. | 175/374 |
| 2007/0215390 | A1 | 9/2007 | Azar et al. | |
| 2011/0005837 | A1 * | 1/2011 | Hoffmaster et al. | 175/57 |

OTHER PUBLICATIONS

International Search Report and Written Opinion of the International Searching Authority for International Application No. PCT/US2009/043061, mailed on Dec. 23, 2009 (11 pages).

* cited by examiner

*Primary Examiner* — Daniel P Stephenson

(74) *Attorney, Agent, or Firm* — Osha Liang LLP

(57) ABSTRACT

A drill bit that includes a body having a lower end face for engaging a rock formation, the end face having a plurality of raised ribs extending from the face of the bit body and separated by a plurality of channels therebetween; and at least one of the plurality of ribs having a cutting portion of the at least one rib comprising a first diamond impregnated matrix material and at least a portion of a gage surface region thereof comprising a second diamond impregnated matrix material, the gage surface region backed by a third matrix material is disclosed.

19 Claims, 4 Drawing Sheets

DIAMOND IMPREGNATED BITS AND METHOD OF USING AND MANUFACTURING THE SAME

BACKGROUND OF INVENTION

1. Field of the Invention

Embodiments disclosed herein relate generally to drill bits, and more particularly to impregnated drill bits and the methods for the manufacture of such drill bits.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper movement of fluid used to remove the rock cuttings and cool the exposed diamonds is important for the proper function and performance of diamond impregnated bits. The cutting face of a diamond impregnated bit typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

An example of a prior art diamond impregnated drill bit is shown in FIG. 1. The impregnated bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impregnated bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impregnated bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 22 in accordance with the '202 patent comprises a shank 24 and a crown 26. Shank 24 is typically formed of steel and includes a threaded pin 28 for attachment to a drill string. Crown 26 has a cutting face 29 and outer side surface 30. According to one embodiment, crown 26 is formed by infiltrating a mass of tungsten-carbide powder impregnated with synthetic or natural diamond, as described above.

Crown 26 may include various surface features, such as raised ridges 32. Preferably, formers are included during the manufacturing process so that the infiltrated, diamond-impregnated crown includes a plurality of holes or sockets 34 that are sized and shaped to receive a corresponding plurality of diamond-impregnated inserts 36. Once crown 26 is formed, inserts 36 are mounted in the sockets 34 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 34 can be inclined with respect to the surface of the crown 26. In this embodiment, the sockets are inclined such that inserts 36 are oriented substantially in the direction of rotation of the bit, so as to enhance cutting.

To form such bits using a powder metallurgy process, as described above, abrasive particles (often diamonds) are placed in a mold, which is then packed with a matrix powder, and infiltrated with a molten binder material to result in the abrasive particles suspended both near and on the surface of the drill bit. In packing the matrix powder materials into the mold, the geometry of the bit (and thus mold) make it difficult to place different matrix materials in different regions of a bit because there is little or no control over powder locations in the mold during assembly, particularly around curved surfaces (shoulder and gage). Thus, a single matrix powder material is typically selected for use in packing the entire bit. Typically, a softer matrix material may be selected so allow for higher rate of penetrations to be achieved, due to the relative easier wear of the matrix material in exposing the diamonds for cutting. However, it may be preferable to use not as soft as a material or the shoulder or gage of the bit may wear down prematurely. Further, too hard of a matrix material would likely create a brittle cone, nose and shoulder area of the bit, resulting in rib cracking and breakage. Thus, frequently, to allow for the use of such softer materials (for ROP), diamond inserts (including diamond impregnated inserts such as the type discussed in the '202 patent described above, PCD inserts or TSP wafers) are frequently brazed or cast into the gage area. However, for extremely abrasive formations or horizontal drilling applications, for example, the use of softer materials (desired for ROP) may still result in premature wearing away, which may lead to pull-out of the inserts or diamond grit particles (due to an increased load) or wear of the gage to an "under-gage" status.

Accordingly, there exists a continuing need for improvements in diamond impregnated cutting structures to improve rate of penetration without sacrificing durability.

SUMMARY OF INVENTION

In one aspect, embodiments disclosed herein relate to a drill bit that includes a body having a lower end face for engaging a rock formation, the end face having a plurality of raised ribs extending from the face of the bit body and separated by a plurality of channels therebetween; and at least one of the plurality of ribs having a cutting portion of the at least one rib comprising a first diamond impregnated matrix material and at least a portion of a gage surface region thereof comprising a second diamond impregnated matrix material, the gage surface region backed by a third matrix material.

In another aspect, embodiments disclosed herein relate to a drill bit that includes a body having a lower end face for engaging a rock formation, the end face having a plurality of raised ribs extending from the face of the bit body and separated by a plurality of channels therebetween; and at least one of the plurality of ribs having a cutting portion of the at least one rib comprising a first diamond impregnated matrix material and at least a portion of a gage surface region thereof comprising a second diamond impregnated matrix material harder than the first diamond impregnated matrix material.

In another aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs comprising, at a portion of a base of the at least one rib extending from the face of the bit body along a sidewall, a first diamond impregnated matrix material, the at least one rib comprising a second diamond impregnated matrix material in a remaining portion of the at least one rib, the second diamond impregnated matrix material being harder than the first diamond impregnated matrix material.

In yet another aspect, embodiments disclosed herein relate to a method of manufacturing a drill bit including a bit body and a plurality of ribs extending from the bit body that includes adhering a plurality of abrasive particles and a first matrix material to at least a vertical portion of a mold cavity corresponding to at least one of the plurality of ribs; loading a plurality of abrasive particles and a second matrix material into the other portions of the mold cavity; and heating the mold contents to form an impregnated drill bit.

In yet another aspect, embodiments disclosed herein relate to a method of manufacturing a drill bit including a bit body and a plurality of ribs extending from the bit body that includes loading a plurality of abrasive particles and a first matrix material in at least a portion of a mold cavity corresponding to a gage portion of at least one of the plurality of ribs; loading a plurality of abrasive particles and a second matrix material into the other portions of the mold cavity; and heating the mold contents to form an impregnated drill bit.

Other aspects and advantages of the invention will be apparent from the following description and the appended claims.

DETAILED DESCRIPTION

In one aspect, embodiments disclosed herein relate to impregnated drill bits and the methods of manufacturing and using the same. More particularly, embodiments disclosed herein relate to impregnated drill bits having tailored material compositions allowing for extension of their use downhole. Specifically, embodiments disclosed herein relate to impregnated drill bits having ribs with harder gage portions and/or tougher supporting base/sidewalls.

Figure 1:
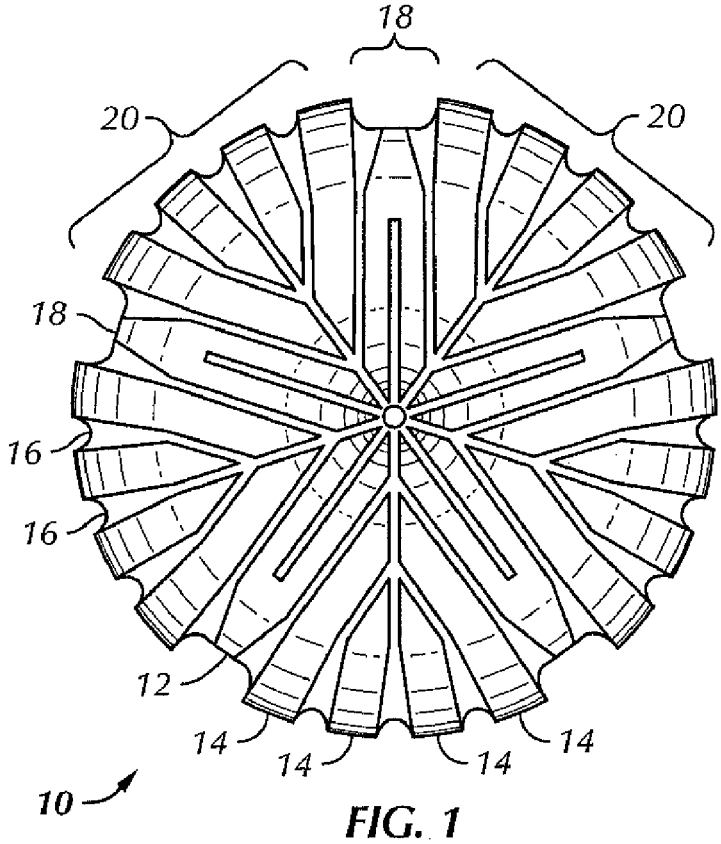
FIG. 1 (Prior Art)
FIG. 1 is a prior art impregnated bit.
Figure 2:
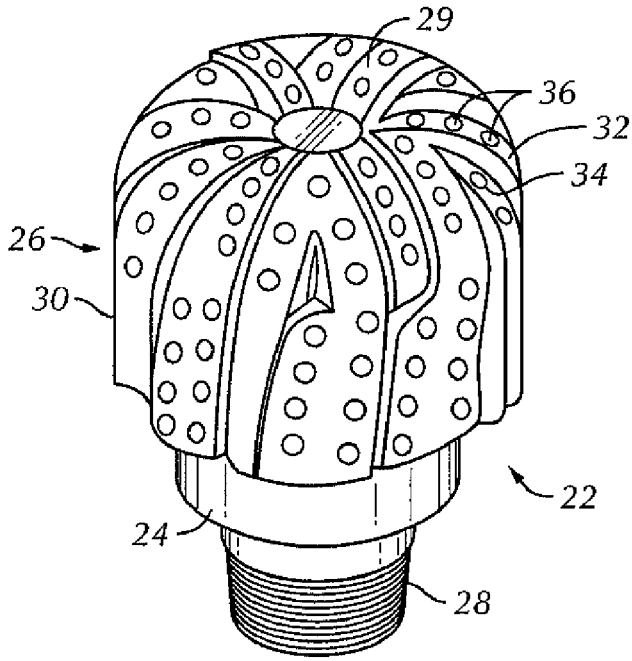
FIG. 2 (Prior Art)
FIG. 2 is a prior art impregnated bit.
Figure 3:
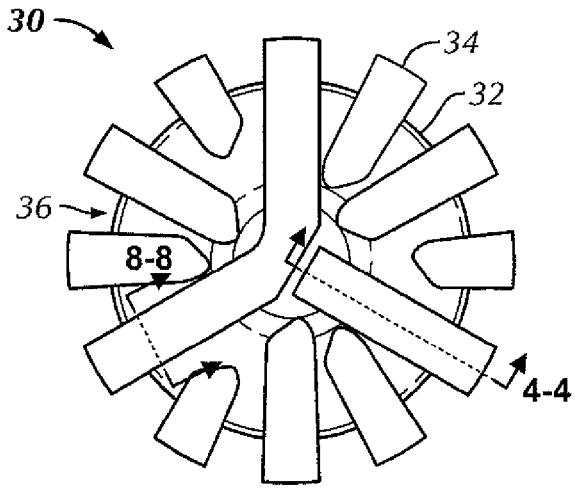
FIG. 3 shows a top view of a drill bit in accordance with one embodiment of the present disclosure.
Figure 4:
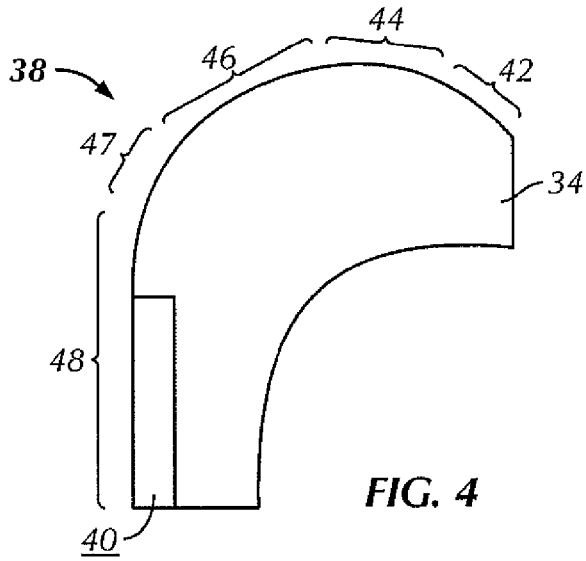
FIG. 4 shows a cross-sectional view of a rib along 4-4 of the bit of FIG. 3.

Referring to FIGS. 3-4, a drill bit in accordance with one embodiment is shown. As shown in FIGS. 3-4, impregnated bit 30 includes a bit body 32 and a plurality of ribs 34 that are extending from the bit body 32. Ribs may extend from a center of the bit body radially outward to the outer diameter of the bit body 32, and then axially downward, to define the diameter (or gage) of the bit 30. The ribs 34 are separated by channels 36 that enable drilling fluid to flow between and both clean and cool the ribs 34. Each rib 34 has a profile 38 defining its general shape/geometry that may be divided into various segments: a cone region 42 (recessed central area), a nose region 44 (leading cutting edge of profile), a shoulder region 46 (beginning of outside diameter of bit), transition region 47 (transition between shoulder and vertical gage), and a gage region 48 (vertical region defining outer diameter of bit). The primary cutting portion of the rib 34 includes cone region 42, nose region 44, and shoulder region 46, Whereas gage region 48 is primarily responsible for maintaining the hole size.

In a conventional impregnated bit, such as formed by infiltrating techniques, a mixture of diamond particles and matrix particles are poured into the rib portions (and a portion of the interior bit body), a softer, machinable powder is typically poured on top of the diamond mixture (thus occupying at least a portion of the mold corresponding to the gage region of the ribs), and the bit is infiltrated with an infiltration binder. However, in accordance with the present disclosure, at least a portion a rib's gage surface is formed using a hard matrix material. As shown in FIG. 4, a portion of gage region 48 is occupied by a diamond impregnated material 40 unique as compared to the material(s) used in the remaining portions of the rib 34 and body 32. In a particular embodiment, diamond impregnated material 40 may be tailored to have a material composition harder than the remaining portions of the rib 34.

Figure 5:
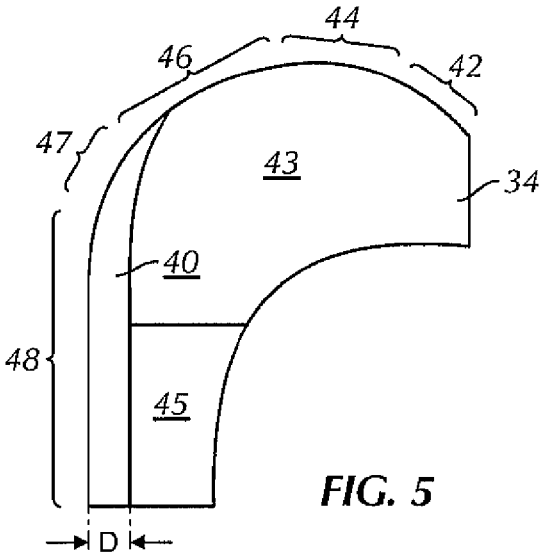
FIG. 5 shows a cross-sectional view of a rib in accordance with an alternate embodiment.

An alternate embodiment is shown in FIG. 5. As shown in FIG. 5, rib 34 is similarly divided into cone region 42, nose region 44, shoulder region 46, transition region 47, and gage region 48. However, as compared to FIG. 4, diamond impregnated material 40 extend beyond the gage region 48, through transition region 47, and into shoulder region 46. Diamond impregnated material 40 may be found a selected distance D into the rib 34 from the surface thereof. The cutting portions of rib 34 may be formed of a second diamond impregnated material 43, while diamond impregnated material 40 at gage region 48 may be backed by a third material 45. In a particular embodiment, it may be desirable to have a cutting portion with a diamond impregnated material 43 tailored to allow for relative ease in diamond exposure to provide improvements in rate of penetration, while forming a gage region 48 with a diamond impregnated material 40 harder than cutting diamond impregnated material 43 so that risk of drilling under gage may be minimized. Further, while such a hard material may be desirable for the gage surface, the backing of diamond impregnated material 40 (or at least a gage portion thereof) may be achieved with a tougher, softer material 45 that is machinable for manufacturing ease. In a particular embodiment, such distance D may be greater than 2 mm (so as to allow for placement of a single layer of diamond particles). However, in other particular embodiments, the thickness may range from 3 to 15 mm.

Figure 6:
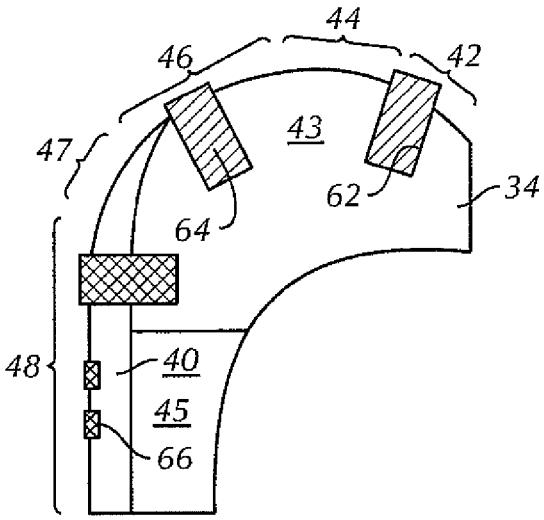
FIG. 6 shows a cross-sectional view of a rib in accordance with an alternate embodiment.

Referring to FIG. 6, yet another embodiment of a rib 34 is shown. As shown in FIG. 6, rib 34 includes diamond impregnated material 40 extending from gage region 48 into shoulder region 46, diamond impregnated material 43 in a cutting portion of the rib, and a material 45 as an inner bit body material. Additionally, rib 34 includes sockets 62 in which preformed impregnated inserts 64 may be affixed. Such inserts 64 may extend along the entire rib profile 38, including into gage region 48. Preformed inserts may include a consolidated or hot pressed insert, such as the type described in U.S. Pat. No. 6,394,202, which is assigned to the present assignee and herein incorporated by reference in its entirety. Similar to other embodiments of impregnated ribs, such preformed inserts may include super abrasive particles dispersed within a continuous matrix material, such as the materials described below in detail. Further, such preformed inserts may be formed from encapsulated particles, as described in U.S. Patent Publication No. 2006/0081402 and U.S. application Ser. Nos. 11/779,083, 11/779,104, and 11/937,969.

Further, as is also shown in FIG. 6, superabrasive wafer elements 66, such as TSP or PCD wafers may be affixed to the surface of gage region 48 of bit to increase the hardness of such exterior portion of the bit. Use of such features (preformed inserts or cutting elements) affixed to the gage region is known in the art, thus, it is within the scope of the present disclosure that such features (or any other features) known in the art of diamond impregnated bits may be used in conjunction with the embodiments of the present disclosure.

Figure 7:
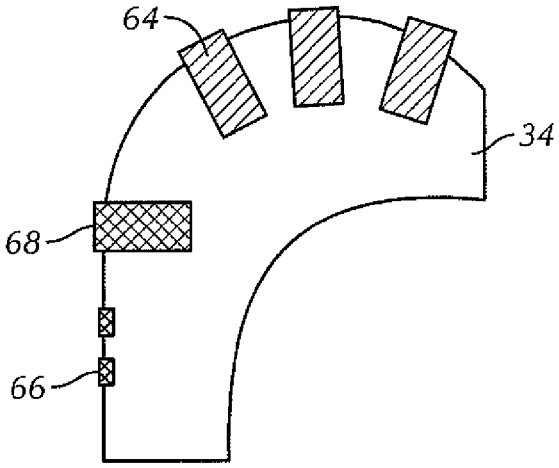
FIG. 7 shows a cross-sectional view of a rib in accordance with an alternate embodiment.

Now referring to FIG. 7, it also is within the scope of the present disclosure that the overall hardness of the gage region may be altered by the use of a preformed impregnated insert (s) 68 having a greater hardness, as compared to the radially inward inserts 64 on the rib 34.

Figure 8:
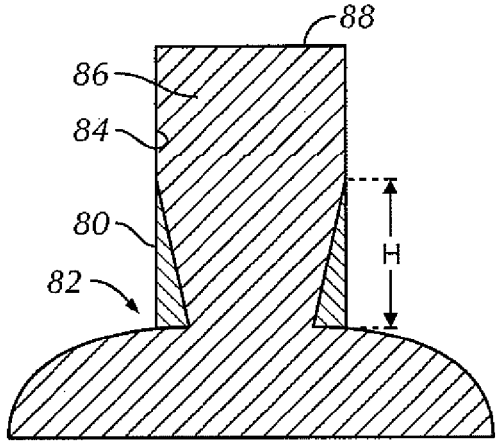
FIG. 8 shows a cross-sectional view along 8-8 of the bit of FIG. 3.
Figure 9:
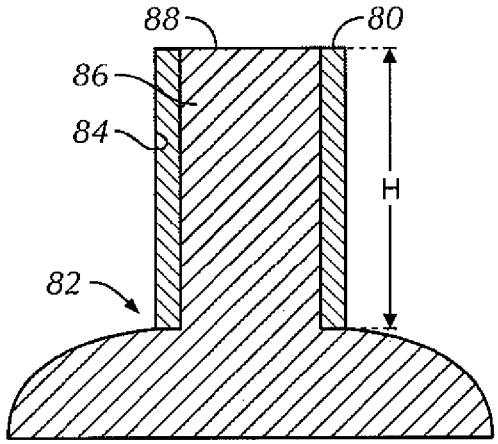
FIG. 9 shows a cross-sectional view of a rib in accordance with an alternate embodiment.

It is also within the scope of the present disclosure that other such "vertical" surfaces may be tailored to a particular desirable bit application. For example, referring to FIG. 8, another embodiment of a rib 34 of the present disclosure is shown. As shown in FIG. 8, rib 34 extends from bit body 32 a selected height H. Thus, area from which rib 34 extends from bit body 32 is referred to as base 82. As shown in FIG. 8, at least a portion of base 82, extending a selected height H along the sidewall 84 of rib 34, is formed from a diamond impregnated material 80, whereas the remaining portion of the rib (primarily forming the top cutting surface 88) is formed from a diamond impregnated material 86. Further, while diamond impregnated material 86 is shown as being continuous with bit body 32, one skilled in the art would appreciate that likely, the bit body may be formed of a material unique from the diamond impregnated ribs. The combination of multiple materials to form different segments of a rib may allow for greater tailoring depending on the particular application. For example, use of a tougher diamond impregnated material 80 may produce generally tougher ribs, particularly as rib height increase, to prevent rib cracking. Referring to FIG. 9, an alternate embodiment is shown. As shown in FIG. 9, diamond impregnated material 80 may extend the entire length of the sidewall 84 from a base 82 to the cutting top of the rib 34, with diamond impregnated material 86 forming the remaining portion of rib 34. Thus, the height H of diamond impregnated material 80 may range from 10 mm to the entire height of rib 34.

Figure 10:
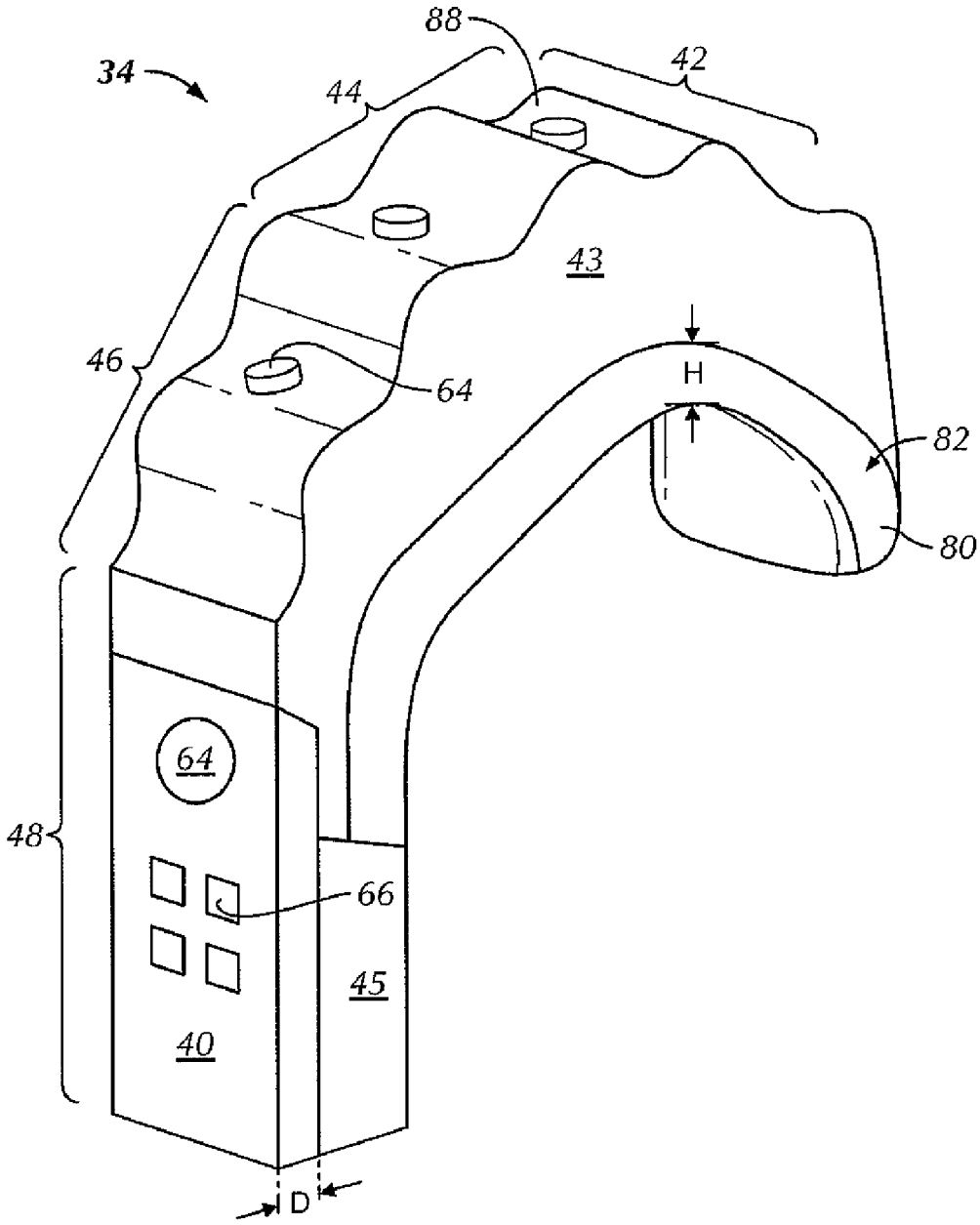
FIG. 10 shows a perspective view of a rib in accordance with one embodiment.

Referring to FIG. 10, yet another embodiment of rib 34 is shown. As shown in rib 34, rib 34 includes a cone region 42, nose region 44, shoulder region 46 (all forming the primary cutting portion of the rib 34), and gage region 48. A surface portion of the gage region 48 may be formed from diamond impregnated material 40 (a selected distance D into rib 34), a base portion 82 of rib 34 (where rib 34 extends from bit body (not shown)) may be formed from diamond impregnated material 80 a selected height H, while the remainder of (including top cutting surface 88) of the collective primary cutting portion 42, 44, 46 may be formed from diamond impregnated material 43. Further, a matrix material 45 may back diamond impregnated material 40 on the gage surface. In a particular embodiment, comparing all of the various materials, the materials may all be selected to having differing material properties (hardness) such that diamond impregnated material 40 is the hardest material, followed in hardness by diamond impregnated material 43, then diamond impregnated material 80, and then matrix material 45. Another embodiment could be such that diamond impregnated material 40 is the hardest material, followed in hardness by diamond impregnated material 80, then diamond impregnated material 43, and then matrix material 45. Further, one skilled in the art would appreciate that a bit body material (while not shown) may also be provided as a different material than those shown. In a particular embodiment, diamond impregnated material 40 may extend along the entire gage surface to the shank (not shown). Further, as shown in FIG. 10, preformed inserts 64 may be included along the entire rib profile, including on the top cutting surface and gage surface. Additionally, super abrasive elements may be affixed to the surface of gage region as well. Further, one skilled in the art would appreciate that while various features or aspects of the present disclosure have all been shown in various combinations in the various figures, any combination of some or all of such features is within the scope of the present disclosure.

Thus, embodiments of the present disclosure provide an impregnated drill bit having various vertical portions of a rib of formed of a unique material, as compared to a neighboring region of the rib. For example, the various portions may be formed from various combinations of matrix material impregnated with super abrasive particles (and/or matrix material without super abrasives). Further, in a particular embodiment, the different regions may be formed of materials to result in a hardness difference of at least 7 HRC and up to 50 HRC between two neighboring regions of the rib.

This difference between the materials used in certain portions of a rib may include variations in chemical make-up or particle size ranges/distribution, which may translate, for example, into a difference in wear or erosion resistance properties of the rib portions. Thus, for example, different types of carbide (or other hard) particles may be used among the different types of matrix materials. One of ordinary skill in the art would appreciate that a particular variety of tungsten carbide, for example, may be selected based on hardness/wear resistance. The hardness of the material may also be varied by altering the amount, type, etc., of super abrasive particles. Further, chemical make-up of a matrix powder material may also be varied by altering the percentages/ratios of the amount of hard particles as compared to binder powder. Thus, by decreasing the amount of tungsten carbide particle and increasing the amount of binder powder in a portion of the rib, a softer portion of the rib may be obtained, and vice versa. In a particular embodiment, the matrix materials may be selected so that a gage region may include a harder material (as compared to the primary cutting portion of the rib), and/or a base region of the rib may include a tougher, softer material (as compared to the primary cutting surface of the rib).

Additionally, in various embodiments, the various portions may be formed of encapsulated particles to provide for impregnation described above. The use of encapsulated particles in cutting structures is described for example in U.S. Patent Publication No. 2006/0081402 and U.S. application Ser. Nos. 11/779,083, 11/779,104, and 11/937,969, all of which are assigned to the present assignee, and herein incorporated by reference in their entireties. Briefly, encapsulated particles are formed of super abrasive particles coated or surrounded by encapsulating shell of matrix powder material. The encapsulated particles may be infiltrated with an infiltrating material that may include an infiltration binder and an optional matrix powder material. Thus, in forming a rib, different types, amounts of encapsulated particles may be used in the various regions of the rib and/or encapsulated particles may be used in one region and not others, etc.

Super Abrasive Particles

The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, the gage portion may be impregnated with particles selected to result in a harder gage surface as compared to the cutting portion. Thus, the impregnated particles may be selected to differ in type (i.e., chemical composition), quality (strength), size, concentration, and/or retention coatings, all of which may alter the resulting materials properties of the rib portions.

The shape of the abrasive particles may also be varied as abrasive particles may be in the shape of spheres, cubes, irregular shapes, or other shapes. In some embodiments, abrasive particles may range in size from 0.2 to 2.0 mm in length or diameter; from 0.3 to 1.5 mm in other embodiments; from 0.4 to 1.2 mm in other embodiments; and from 0.5 to 1.0 mm in yet other embodiments.

However, particle sizes are often measured in a range of mesh sizes, for example −40+80 mesh. The term "mesh" actually refers to the size of the wire mesh used to screen the particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the particles is defined by the largest and smallest grade of mesh used to screen the particles. Particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm.

Thus, in some embodiments, abrasive particles may include particles not larger than would be filtered by a screen of 10 mesh. In other embodiments, abrasive particles may range in size from −15+35 mesh. In a particular embodiment, the leading portion may include abrasive particles ranging in size from −25+35 mesh, while the trailing portion may include abrasive particles ranging in size from −20+25 mesh. However, one of ordinary skill would recognize that the particle sizes and distribution of the particle sizes of the abrasive particles may be selected to allow for a broad, uniform, or bimodal distribution, for example, depending on a particular application, and that size ranges outside the distribution discussed above may also be selected. Further, although particle sizes or particle diameters are referred to, it is understood by those skilled in the art that the particles may not necessarily be spherical in shape.

Further, as discussed above, various abrasive particles that may be selected for use in the ribs may vary in type (i.e., chemical composition) such that the various portions of a rib may use different types of abrasive particles; however, one of ordinary skill in the art would appreciate that among these particles, there may also be a difference in compressive strength of the particles. For example, some synthetic diamond grit may have a greater compressive strength than natural diamond grit and/or reclaimed grit. Furthermore, even within the general synthetic grit type, there may exist different grades of grit having differing compressive strengths, such as those grades of grit commercially available from Element Six Ltd. (Berkshire, England). For example, recycled diamond grit (reduced strength due to multiple high temperature exposures) could be used as the abrasive particles within one segment so as to render that segment less wear resistant than a neighboring segment.

In addition to varying the strength of the abrasive particles, the presence and chemical identity of a retention coating on the surface of the abrasive particle may also optionally be varied. Such retention coatings may be applied by conventional techniques such as CVD or PVD. One of ordinary skill in the art would appreciate that the thin coatings (having a thickness of only a few micrometers) may be more helpful for high temperature protection (e.g., SiC coatings) while others are helpful for grit retention (e.g., TiC). In certain embodiments, the retention coating (TiC in the above example) may help bond the diamond to the "outer" matrix material in which the abrasive particles are impregnated. Additionally, in certain applications the retention coating may reduce thermal damage to the particles. For example, different coatings may be used between abrasive particles on the various rib portions, such as for example, a weaker PVD coating could be applied on the particles in a first segment of the rib, and a stronger CVD coating on abrasive particles in a second segment of the rib, leading to a less wear resistant first segment. One example is to use a high temperature protection coating, such as SiC for gage area diamond grit (43 and 64) for improved thermal protection, and thus improved wear resistance on gage, while using lower temperature coating, such as TiC, for regions 43 and 80 to maintain good ROP performance.

Matrix Material

The impregnated particles may be dispersed in a continuous matrix material formed from a matrix powder and infiltrating binder material. The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials.

Further, with respect to particle sizes, each type of matrix material (for respective portions of a rib) may be individually be selected from particle sizes that may range in various embodiments, for example, from about 1 to 200 micrometers, from about 1 to 150 micrometers, from about 10 to 100 micrometers, and from about 5 to 75 micrometers in various other embodiments or may be less than 50, 10, or 3 microns in yet other embodiments. In a particular embodiment, each type of matrix material (for respective rib segments) may have a particle size distribution individually selected from a mono, bi- or otherwise multi-modal distribution.

One of ordinary skill in the art would appreciate that the type of matrix materials, i.e., the types and relative amounts of tungsten carbide, for example, may be selected based on the location of their use in a mold, so that the various rib portions have the desired hardness/wear resistance for the given location. In addition to varying the type of tungsten carbide (as the various types of tungsten carbide have inherent differences in material properties that result from their use), the chemical make-up of a matrix powder material may also be varied by altering the percentages/ratios of the amount of hard particles as compared to binder powder. Thus, by decreasing the amount of tungsten carbide particle and increasing the amount of binder powder in a portion of the rib, a softer portion of the rib may be obtained, and vice versa.

Types of Tungsten Carbide

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

Referring back to FIG. 10, in a particular embodiment, various combinations of materials suitable for use in the present disclosure are envisioned. In a particular embodiment, diamond impregnated material 40 in gage region 48 may be formed from 120 concentration 25/35 mesh SiC coated grit with a hard GM 55 matrix (available from Smith International, Inc. (Houston, Tex.)). Diamond impregnated material 80 along the base 82 of rib 34 may be formed from 80 concentration 20/25 mesh TiC coated grit with soft GM52 matrix (available from Smith International, Inc. (Houston, Tex.)). Diamond impregnated material 43, forming the primary cutting portion of rib 34, may be formed from 100 concentration 20/25 mesh TiC coated grit with soft GM52 matrix material (available from Smith International, Inc. (Houston, Tex.)). Finally, matrix material 45, backing the diamond impregnated material 40, may be formed from a tungsten/nickel powder, also known as a machinable shoulder powder.

As discussed above, combinations of materials (and material properties) may be used in forming the ribs of the present disclosure. It is specifically within the scope of the present disclosure that materials may be selected for the various regions of the rib to provide a differential in hardness/toughness, etc, depending on the loads and potential failure modes frequently experienced by that region of the rib. For example, in a particular embodiment, a base of a rib may be formed of a less hard or tougher material than the top height of the rib so as to provide greater support and durability to the rib, and reduce or prevent the incidents of rib breakage, which may be experienced particularly as rib height increases. Further, it is also within the scope of the present disclosure to provide a gage surface that has an increased hardness, so as to prevent or reduce the incidents of drilling undergage, while avoiding use of such harder materials in the primary cutting region which would be too brittle and likely result in rib cracking and breakage. In particular, steerable bits and horizontal drilling applications require a harder gage area to resist the high stress three-body abrasive wear, making bits of the present application particularly suitable for use in such applications.

The ribs of the present disclosure have vertically oriented portions thereof (when formed in a mold) tailored with a varying material composition depending on the particular region of the rib, unattainable by conventional powder metallurgy techniques. Manufacturing of a bit in accordance with the present disclosure may begin with the fabrication of a mold, having the desired body shape and component configuration, including rib geometry. Using conventional powder metallurgy, creating a surface gage region (or other vertical surface) from a separate powder material (as compared to neighboring regions of a rib would be infeasible, if not impossible, as within a mold, the powders would too easily mix together. However, in accordance with embodiments of the present disclosure, a mixture of matrix material and diamond (for example, in a clay-like mixture) may be loaded into the mold, and place in the desired location of the mold, corresponding to the regions of the rib desired to have different material properties. The other regions or portions of the rib may be filled with a differing material, and the ribs may be infiltrated with a molten infiltration binder and cooled to form a bit body. Optionally, a matrix material, and optionally a metal binder powder, may be loaded on top of the diamond mixtures loaded in the rib portions. In a particular embodiment, during infiltration a loaded matrix material may be carried down with the molten infiltrant to fill any gaps between the particles. Further, one skilled on the art would appreciate that other techniques such as casting may alternatively be used.

In a particular embodiment, the materials (diamond and matrix powder) may be combined as premixed pastes, which may then be packed into the mold in the respective portions of the mold, such that along the vertical gage surface and/or sidewall of the rib. By using a paste-like mixture of superabrasives, carbides, and metal powders, the mixture may possess structural cohesiveness beneficial in forming a rib having the material make-up disclosed herein. Additionally, the material may be formable or moldable, similar to clay, which may allow for the material to be shaped to have the desired thickness, shape, contour, etc., when placed or positioned in a mold. Further, as a result of the structural cohesiveness, when placed in a mold, the material may hold in place without encroaching the opposing portion of the mold cavity. To be moldable, such materials may have a viscosity of at least about 250,000 cP. However, in other embodiments, the materials may have a viscosity of at least 1,000,000 cP, at least 5,000,000 cp in another embodiment, and at least 10,000,000 cP in yet another embodiment. Further, the material may be designed to possess sufficient viscidity and adhesive strength so that it can adhere to the mold wall during the manufacturing process, without moving, specifically, it may be spread or stuck to a surface of a graphite mold, and the mold may be vibrated or turned upside down without the material falling. Thus, for a given material, the adhesive strength should be greater than the weight of the material per given contact area (with the mold) of the material. Once such materials are adhered to the particular desired vertical surfaces, the remaining portions of rib cavities (corresponding to cutting portions for example) may be filled using a diamond/matrix powder mixture or encapsulated particles. A bit body material may be loaded into the rib material, and a softer matrix powder may be loaded thereon (particularly to serve as the backing of the gage surface). In a particular embodiment, a tough (and machinable) matrix material may be loaded from approximately 0.5 inches from the gage point to fill the mold. The entire mold contents may then be infiltrated using an infiltration binder (by heating the mold contents to a temperature over the melting point of the infiltration binder), as known in the art.

Advantageously, embodiments of the present disclosure for at least one of the following. Prior art techniques have not allowed for use of two different matrix material to be mixed in a mold due to lack of controllability of the powder locations in the mold during assembly, particularly along curved surfaces. Bits of the present disclosure may include use of harder materials on the gage (for abrasive areas and horizontal applications) which may reduce the wearing of the gage matrix material, which in turn may decrease the loads on gage insert features and incidents of drilling under gage. Use of such harder materials at gage surfaces may be achieved while maintaining a slightly softer material on the primary cutting surfaces to prevent the use of brittle materials (leading to rib cracking and breaking). Furthermore, the use of pelletized grit on the gage has shown to offer improved diamond grit retention properties, thus improving gage wear resistance. Additionally, embodiments also provide for the use of a tougher material at a base portion of a rib, providing increased toughness to a rib, so that taller ribs (and greater rate of penetrations) may be achieved, without sacrificing durability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a body having a lower end face for engaging a rock formation, the end face having a plurality of raised ribs extending a height from the face of the bit body and separated by a plurality of channels therebetween; and at least one of the plurality of ribs having a cutting portion of the at least one rib comprising a first diamond impregnated matrix material and at least a portion of a gage surface region thereof comprising a second diamond impregnated matrix material extending from the gage surface a distance into the rib, wherein the second diamond impregnated matrix material at the gage surface region is backed by a third matrix material.

2. The drill bit of claim 1, further comprising:

at least one superabrasive element affixed to the gage region of the at least one rib.

3. The drill bit of claim 1, further comprising:

at least one socket disposed in the at least one rib; and at least one preformed impregnated insert disposed in the at least one socket extending a selected distance from the surface of the rib.

4. The drill bit of claim 3, wherein the at least one preformed impregnated insert is disposed in the gage region of the at least one rib.

5. The drill bit of claim 3, wherein the at least one preformed impregnated insert is disposed in an inner profile region as compared to the gage region.

6. The drill bit of claim 1, wherein the second matrix material is harder than the first matrix material.

7. The drill bit of claim 1, wherein the diamonds impregnated in the gage region differ in at least one of size, type, and quantity as the remainder of the rib.

8. The drill bit of claim 1, wherein the first matrix material extends from a surface of the at least one rib a selected depth into the rib, the remainder of the depth comprising the third matrix material.

9. The drill bit of claim 8, wherein the selected depth ranges from 3 to 15 mm.

10. A drill bit, comprising:

a body having a lower end face for engaging a rock formation, the end face having a plurality of raised ribs extending from the face of the bit body and separated by a plurality of channels therebetween; and at least one of the plurality of ribs having a cutting portion of the at least one rib comprising a first diamond impregnated matrix material and at least a portion of a gage surface region thereof comprising a second diamond impregnated matrix material harder than the first diamond impregnated matrix material.

11. The drill bit of claim 10, further comprising:

at least one superabrasive element affixed to a gage region of the at least one rib.

12. The drill bit of claim 10, further comprising:

a plurality of sockets disposed in the at least one rib, at least one socket disposed in the gage region; and a plurality of preformed impregnated insert disposed in each of the plurality of sockets extending a selected distance from the surface of the rib.

13. The drill bit of claim 12, wherein the at least one preformed impregnated insert disposed in the gage region is harder than the other of the plurality of preformed impregnated inserts.

14. The drill bit of claim 10, wherein the diamonds impregnated in the gage region differ in at least one of size, type, and quantity as the remainder of the rib.

15. A drill bit, comprising:

a body having a lower end face for engaging a rock formation, the end face having a plurality of raised ribs extending from the face of the bit body and separated by a plurality of channels therebetween;

at least one of the plurality of ribs comprising;

at a portion of a base of the at least one rib extending from the face of the bit body along a sidewall, a substantially continuous composition of a first diamond impregnated matrix material;

a substantially continuous composition of a second diamond impregnated matrix material in a remaining portion of the at least one rib, the second diamond impregnated matrix material being harder than the first diamond impregnated matrix material; and an infiltration binder disposed throughout the first diamond impregnated matrix material and the second diamond impregnated matrix material.

16. The drill bit of claim 15, wherein the first diamond matrix material extends from the base along the sidewall a selected height.

17. The drill bit of claim 16, wherein the first diamond matrix material extends from the base along the entire sidewall of the rib.

18. The drill bit of claim 16, wherein the third diamond impregnated matrix material in the the gage surface region is backed by a fourth matrix material.

19. The drill bit of claim 15, at least a portion of a gage surface region of the at least one rib comprising a third diamond impregnated matrix material harder than the first diamond impregnated matrix material and the second diamond impregnated matrix material.

* * * * *